United States Patent [19]

Lisec

[11] Patent Number: 4,929,814

[45] Date of Patent: May 29, 1990

[54] APPARATUS FOR HEATING THE MARGINAL ZONE OF GLASS SHEETS

[76] Inventor: Peter Lisec, Bahnhofstrasse 34, Amstetten-Hausmening, Austria, A-3363

[21] Appl. No.: 252,931

[22] Filed: Oct. 4, 1988

[30] Foreign Application Priority Data

Oct. 5, 1987 [AT] Austria ..... A252887

[51] Int. Cl.[5] ..... H05B 3/06

[52] U.S. Cl. ..... 219/388; 219/411

[58] Field of Search ..... 219/388, 405, 411, 354, 219/390, 343, 345; 34/4, 150, 13, 17

[56] References Cited

U.S. PATENT DOCUMENTS

| | | | |
|---|---|---|---|
| 2,680,304 | 6/1954 | Herbert | 219/388 |
| 2,999,338 | 9/1961 | Richardson | 219/535 |
| 3,402,475 | 9/1968 | Johansen | 34/236 |

FOREIGN PATENT DOCUMENTS

| | | |
|---|---|---|
| 0061183 | 9/1982 | European Pat. Off. . |
| 2035783 | 6/1979 | Fed. Rep. of Germany . |
| 3002904 | 8/1980 | Fed. Rep. of Germany . |
| 3310441 | 9/1984 | Fed. Rep. of Germany . |
| 2287278 | 5/1976 | France . |

*Primary Examiner*—Teresa J. Walberg
*Attorney, Agent, or Firm*—Young & Thompson

[57] ABSTRACT

An apparatus for heating the marginal zone of glass sheets to which prefabricated spacer strips are to be applied includes a lateral support (1) for the glass sheets and a linear conveyor (2) provided at the lower rim of the support (1), constituted, for example, by a series of conveying rollers (3). Furthermore, two horizontally aligned, elongated heating elements (5, 6) associated with the horizontal marginal zones of the glass sheet are provided. One (5) of the horizontally aligned heating elements (5, 6) is arranged immediately above the linear conveyor (2), and the other one (6) is movable upwards and downwards (arrow 18) along the lateral support (1). Both horizontal heating elements (5, 6) are attached to supports (7, 8) pivotable about horizontal axes (9, 10) that the heating elements (5, 6) can be swung away from their operative position associated with the glass sheet. Finally, an elongated (5), substantially vertically aligned heating device (14) is provided which is arranged beside the vertical rim (13) of the lateral support (1) on the discharge side and exhibits two mutually facing heating elements (15, 16).

5 Claims, 1 Drawing Sheet

APPARATUS FOR HEATING THE MARGINAL ZONE OF GLASS SHEETS

Figure 2:
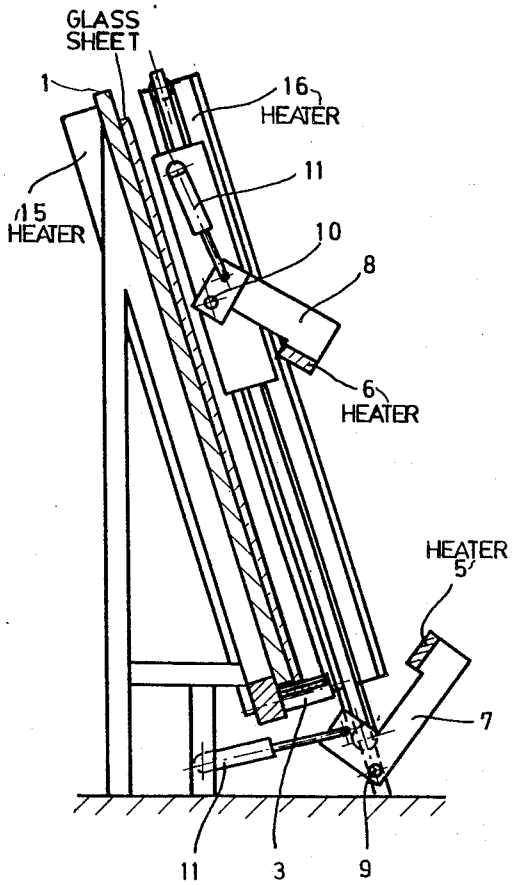

The invention relates to an apparatus for heating the marginal zone of glass sheets to which prefabricated spacer strips are to be applied, with a lateral support for the glass sheets, with a linear conveyor provided at the lower rim of the support, consisting, for example, of a series of conveying rollers, with two horizontally aligned, elongated heating elements associated with the horizontal marginal zones of the glass sheets, one of the horizontally aligned heating elements being arranged immediately above the linear conveyor and the other one of the horizontally aligned heating elements being movable upwards and downwards along the lateral support, and with an elongated heating device oriented substantially vertically.

The attachment of prefabricated spacer strips to glass sheets during the course of the manufacture of insulating glass panes requires a minimum temperature of the glass sheet and/or of the spacer strip so that a firm hold of the prefabricated, flexible spacer strip (swiggle strip) at the glass sheet is achieved. Heating of prefabricated spacer strips, as they are known, for example, from DOS 3,002,904, is not readily possible, or can be performed only to a limited extent, inasmuch as such spacer strips would adhere to the guide and rerouting rollers provided in the applicator tools. An apparatus for the attachment of swiggle strips has been known, for example, from DOS 3,310,441.

On the other hand, there is little sense in heating a glass sheet, to which such a prefabricated spacer strip is to be applied, in its entirety.

A device has been known from EP-B-061,183, by means of which the marginal areas of insulating glass panes can be heated up in order to activate the adhesive, used for coating a spacer strip frame inserted between the glass sheets of the insulating glass pane, by means of supplying heat thereto, so that an adhesive bond is established between the spacer strip and the two glass sheets.

The heating elements of the device known from EP-A-061,183 are arranged to be movable exclusively in parallel to the plane of the glass sheets to be heated in the marginal zone. EP-A-061,183 does not contain a suggestion for providing the horizontal heating elements on holders that can be swung out.

The invention is based on the object of providing an apparatus of the type discussed hereinabove which is of a simple structure and by means of which the marginal zones of a glass sheet can be quickly heated up prior to attachment of a prefabricated spacer strip (swiggle strip). Furthermore, the apparatus of this invention is to lend itself to integration, without problems, into a line for the manufacture of insulating glass.

According to the invention, this object has been attained in an apparatus of the type mentioned above by providing that the horizontal heating elements are attached to supports pivotable about horizontal axes so that the heating elements can be swung out of their operative position associated with the glass sheet; and that the vertically aligned heating device is arranged beside the vertical rim of the lateral support on the discharge side and exhibits preferably two mutually facing heating elements.

With the use of the apparatus of this invention, which can be integrated without problems into facilities for the manufacture of insulating glass wherein the glass sheets are conveyed and treated horizontally or preferably in vertical orientation, the marginal zones of the glass sheets can be quickly heated up to the desired temperature.

Since the horizontal heating elements can be swung out of their operative position associated with the glass sheet, and since the vertically oriented heating device is provided beside the vertical rim of the lateral support on the discharge side, the heating elements can be maintained constantly at their temperature while the apparatus is in operation, without there being an overheating of the remaining parts of the apparatus, so that the heating elements need not be heated up first once a glass sheet has been transported into the apparatus. In this way, a very short cycle time is made possible.

Figure 1:
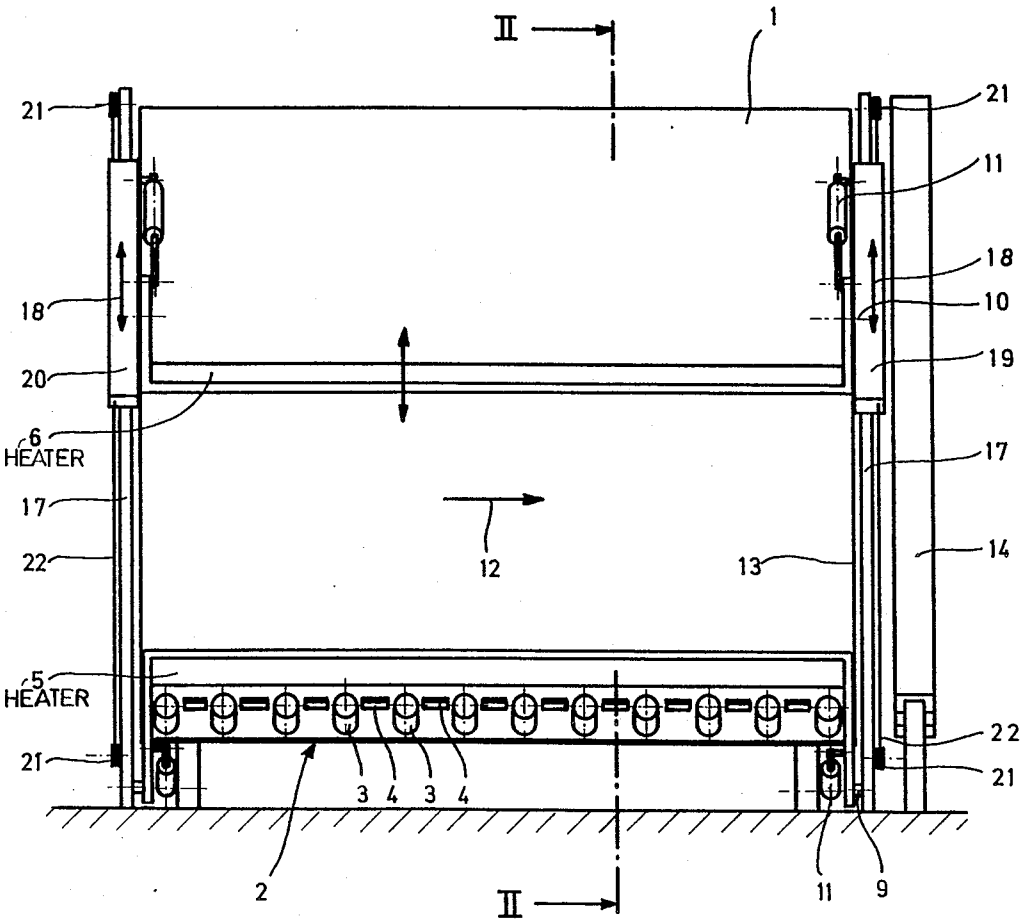

Additional details and features of the invention can be seen from the dependent claims and from the following description of the embodiment schematically shown in the drawing wherein:

FIG. 1 shows an apparatus for heating the marginal zone of glass sheets, in a frontal view, and FIG. 2 shows a section along line II—II in FIG. 1.

The apparatus illustrated in FIG. 1 comprises a lateral support 1 for the glass sheets to be treated, these glass sheets being transported while inclined rearwardly by a few degrees, as is customary in modern insulating glass manufacturing installations. The glass sheets rest on the lateral support 1, for example by way of supporting rollers, not shown, freely rotatable about axes oriented in parallel to the plane of the lateral support 1, i.e. being substantially vertical. A linear conveyor 2 is provided at the lower rim of the lateral support 1; in the illustrated embodiment, this conveyor is constituted by a series of conveying rollers 3, the axes of which are oriented perpendicularly to the plane of the lateral support 1. It can also be seen from FIG. 1 that cover plates 4 are arranged between the individual conveying rollers 3 of the linear conveyor 2, the conveying rollers 3 projecting to a slight extent in the upward direction between these cover plates.

Two horizontally aligned, elongated heating elements 5 and 6 are provided in the apparatus. The heating elements 5 and 6 are attached to supports 7 and 8 pivotable about essentially horizontal axes 9 and 10, respectively, with the aid of pressure medium motors 11. In this way, the heating elements 5 and 6 can be swung away from their operative position shown in FIG. 1 wherein they are associated with the lower horizontal marginal zone (heating element 5) and, respectively, the upper horizontal marginal zone (heating element 6) of a glass sheet into a nonoperative position (FIG. 2). Therefore, the lateral support 1 and the linear conveyor 2 are not exposed to the radiant heat of the heating elements 5 and 6 when there is no glass sheet being heated up in the apparatus at that time.

A heating device 14 is provided beside the vertical rim 13 of the lateral support 1, which rim is located at the rear, based on the conveying direction (arrow 12); this heating device consists of two mutually facing heating elements 15 and 16 (FIG. 2). A gap is left vacant between the two heating elements 15 and 16 of the heating device 14, a glass sheet moving through this gap. The heating device 14 serves for heating up the substantially vertical sections of the marginal zones of the glass sheet.

In order to be able to align the upper one of the two horizontally oriented, elongated heating elements 5 and 6, i.e. heating element 6, with respect to the upper, horizontal section of the marginal zone of a glass sheet, the support 8 of this heating element 6 is supported in the machine frame 17 and, respectively, on slides 19 and 20 guided to be displaceable upwards and downwards (arrows 18) on guide rails connected to this frame. The slides 19 and 20 of the heating element 6 are vertically oriented by means of their drive mechanisms with the aid of a control unit to which is fed a signal corresponding to the height of the glass sheet to be heated up in the marginal zone, in such a way that the upper heating element 6 is oriented in opposition to the upper section of the marginal zone of a glass sheet once it has been swung into its operative position.

Cable tackles or the like can be provided for operating the slides 19 and 20, these tackles being guided over guide rollers 21.

The aforedescribed apparatus operates as follows:

A glass sheet is conveyed, resting on the lateral support 1, into the apparatus by the linear conveyor 2 and transported in this apparatus until the essentially vertically oriented rim of the glass sheet, located at the front as based on the conveying direction (arrow 12) has been placed between the heating elements 15 and 16 of the heating device 14. During transport of the glass sheet, the upper horizontal heating element 6 is oriented in correspondence with the height of the glass sheet, and the heating elements 5 and 6 are swung into their operative positions by activation of the pressure medium motors 11 as soon as the glass sheet, as described above, has been aligned. As soon as the forward, vertically oriented section and the two horizontally aligned sections of the marginal zone of the glass sheet have been adequately heated up, the glass sheet is further transported until its rearward marginal zone, based on the conveying direction (arrow 12), is located in the region of the heating device 14. During this movement of the glass sheet, or thereafter, the horizontally oriented heating elements 5 and 6 are swung out of their operative positions. After, then, also the rearward marginal zone of the glass sheet has been heated up, the glass sheet is passed on preferably immediately to a device for the attachment of a spacer strip (swiggle strip).

What is claimed is:

1. Apparatus for heating the marginal zone of glass sheets to which prefabricated spacer strips are to be applied, comprising a lateral support (1) for glass sheets, with a linear conveyor (2) provided at a lower rim of the support (1), said conveyor including a series of conveying rollers (3), with two horizontally aligned, elongated heating elements (5, 6) associated with horizontal marginal zones of the glass sheets, one (5) of the horizontally aligned heating elements (5, 6) being arranged immediately above the linear conveyor (2) and the other one (6) of the horizontally aligned heating elements (5, 6) being movable upwards and downwards (arrow 18) along the lateral support (1), and with an elongated heating device (14) oriented substantially vertically, characterized in that the horizontally aligned heating elements (5, 6) are attached to supports (7, 8) pivotable about horizontal axes (9, 10), so that the heating elements (5, 6) can be swung away from their operative position associated with the glass sheet, and that the elongated heating device (14) is provided beside a vertical rim (13) of the lateral support (1) on a discharge side and includes two mutually facing heating elements (15, 16).

2. Apparatus according to claim 1, characterized in that the vertically aligned heating device (14) is rigidly mounted in a frame (17) of the apparatus.

3. Apparatus according to claim 1, characterized in that a control means is provided which places the linear conveyor (2) at the lower rim of the lateral support (1) into operation until a vertical rim of the glass sheet, which is at the front based on the conveying direction (arrow 12), is located within of the vertical heating device (14), which swings the horizontally aligned heating elements (5, 6) away after heating up the horizontal marginal zones of the glass sheet, and which reactivates the linear conveyor (2) until the vertical rim of the glass sheet which is at the rear, based on the conveying direction, is located within range of the vertical heating device (14), whereupon, after heating up this marginal zone, a drive mechanism for the linear conveyor (2) is reactivated in order to convey the glass sheet out of the apparatus.

4. Apparatus according to claim 1, characterized in that the apparatus is arranged directly upstream of a station for the attachment of prefabricated spacer strips to the glass sheet heated in the marginal zones.

5. Apparatus according to claim 1, characterized in that cover plates (4) are provided between the rollers (3) of the linear conveyor (2).

* * * * *